US006523922B2

(12) United States Patent
Hirayama

(10) Patent No.: US 6,523,922 B2
(45) Date of Patent: Feb. 25, 2003

(54) PRINTHEAD AS WELL AS PRINTING APPARATUS COMPRISING SUCH PRINTHEAD

(75) Inventor: Nobuyuki Hirayama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/822,193

(22) Filed: Apr. 2, 2001

(65) Prior Publication Data

US 2001/0045968 A1 Nov. 29, 2001

(30) Foreign Application Priority Data

Apr. 3, 2000 (JP) ..... 2000-101481

(51) Int. Cl.[7] ..... B41J 29/38; B41J 29/393
(52) U.S. Cl. ..... 347/9; 347/19
(58) Field of Search ..... 347/9, 19

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,608,577 A | | 8/1986 | Hori | 347/66 |
| 4,723,129 A | | 2/1988 | Endo et al. | 347/56 |
| 4,740,796 A | | 4/1988 | Endo et al. | 347/56 |
| 5,083,137 A | * | 1/1992 | Badyal et al. | 347/14 |
| 5,682,185 A | * | 10/1997 | Wade et al. | 347/19 |
| 5,943,070 A | | 8/1999 | Kamiyama et al. | 347/19 |
| 6,204,671 B1 | * | 3/2001 | Katsuma | 324/678 |
| 6,439,678 B1 | * | 8/2002 | Norton | 347/9 |

FOREIGN PATENT DOCUMENTS

| | | | |
|---|---|---|---|
| DE | 40 20 885 A1 | 6/1990 | B41J/2/05 |
| EP | 0 499 373 A2 | 1/1992 | B41J/2/355 |
| EP | 0 822 072 A2 | 2/1998 | B41J/2/05 |
| JP | 54-056847 | 5/1979 | B41M/5/06 |
| JP | 59-123670 | 7/1984 | B41J/3/04 |
| JP | 59-138461 | 8/1984 | B41J/3/04 |
| JP | 60-71260 | 4/1985 | B41J/3/04 |
| JP | 7-76077 | 3/1995 | B41J/2/01 |
| JP | 10-95116 | 4/1998 | B41J/2/05 |

OTHER PUBLICATIONS

Patent Abstracts of Japan, vol. 1999, No. 04, Apr. 30, 1999 (JP 11 020268, Jan. 26, 1999).

* cited by examiner

*Primary Examiner*—John Barlow
*Assistant Examiner*—Alfred E. Dudding
(74) *Attorney, Agent, or Firm*—Fitzpatrick, Cella, Harper & Scinto

(57) ABSTRACT

A printing apparatus having a plurality of printing elements connected to a common power supply, each printing element is provided with a switching element connected to the printing element in series for controlling driving of the printing element with a voltage applied to a control terminal; a constant voltage source using the power supply as a standard, and a voltage control circuit for controlling the terminal-to-terminal potential difference of the printing element to be equal to a voltage of the constant voltage source, when the printing element is driven, and when storage, driving signals to be supplied to each printing element are controlled so that energy amount consumed by each printing element is equal. Thereby a consumed energy amount in each printing element, that is, an energy amount generated at the time of driving becomes constant regardless of external conditions and environments of the printhead, resulting in high image quality storage.

15 Claims, 7 Drawing Sheets

PRINTHEAD AS WELL AS PRINTING APPARATUS COMPRISING SUCH PRINTHEAD

FIELD OF THE INVENTION

The present invention relates to a printhead as well as a printing apparatus comprising the printhead, and in particular relates to a printhead, which can allow driving conditions to be equal in a plurality of printing elements connected to a common power supply, as well as a printing apparatus comprising the printhead.

BACKGROUND OF THE INVENTION

As an information outputting apparatus in, for example, a word processor, a personal computer, a facsimile, etc., there is a printer which records information such as desired characters and images onto printing media in a sheet form such as a paper sheet and a film.

As a printing system of a printer, various systems are known, and in recent years, an ink-jet system has caught attention because non-contact printing onto printing media such as a paper sheet, etc. is feasible and colorization is easy and is very calm, etc. As its configuration, a serial printing system is being widely used, which is equipped with a printhead to discharge ink according to desired record information and performs printing while reciprocally scanning in a direction perpendicular to the feed direction of the printing media such as a paper sheet, etc., since it is inexpensive and can be miniaturized easily.

Among ink-jet systems, a bubble jet printing system is a system which heats and evaporates ink rapidly with a heating body (heater) so as to discharge ink droplets from an orifice with pressure of created bubble.

FIG. 4 is a circuit diagram showing an example of a heater driving circuit inside a printhead of an ink-jet printer which performs printing by a bubble jet storage method.

Heater elements R1 formed onto element substrate of the printhead and switching elements Q1 for switching currents to those heater elements are connected in series between a power supply VH and the ground, and control signals corresponding with storage information from the main body of the printer switch on or off any switching element to cause nozzles corresponding to the driven heater element to discharge ink thus forming an image.

In order to obtain a high quality image in a printer having a printhead which discharges ink by utilizing heat energy generated by such heater elements, it is necessary to keep the volume of ink droplets discharged to be stabilized constant. For that purpose, it is desirable that the heating value of the heater is kept constant.

Here, the heating value P in a heater converting electric energy into heat energy is expressed as:

$$P=(V^2/R)t \quad (1)$$

Where

V: potential difference in the heater

R: resistivity of the heater

T: voltage application time.

As apparent from the equation (1), the heating value in a heater varies largely depending on heaters' resistivity as well as voltages to be applied to heaters. Among them, the heaters' resistivity has a variation around 20% due to heaters' manufacturing process. As a method to suppress such a variation to affect heating value, methods described in Japanese Patent Laid-Open No. 7-76077 and Japanese Patent Laid-Open No. 10-95116 are known.

The method described in the former publication is the one in which resistivity of a dummy heater formed of the same material as the heater for ink discharge inside the printhead is measured, resistivity of the heater for ink discharge is calculated with this resistivity, and according to the calculated resistivity of the heater, pulse width of pulse signals to be applied to the heater is adjusted to optimize the heating value of heaters.

In addition, in the method described in the latter publication, on-resistance of switching elements such as MOS transistors, etc. to be directly connected to heaters suffer has a variation due to manufacture. Since the on-resistance of this MOS transistors is inserted between a power supply and the ground in series with heaters resistance, a voltage applied to the heater will be a power supply voltage divided by a ratio of the heater resistance to the on-resistance of the MOS transistor.

Therefore, a variation in the on-resistances of MOS transistors is equivalent to a change in the component V in the equation (1), influencing the heat values of the heaters. In order to suppress this influence, as in the methods of the above described publications, a method is used in which a dummy MOS transistor is formed inside a printhead, on-resistance of this MOS transistor is measured, a voltage V applied to a heater is calculated, and with that result, pulse width of pulse signals to be applied to the heater is adjusted so that the heating value of heaters is kept constant.

However, in the above described prior art embodiment, a variation of heaters resistance and on-resistance of MOS transistors connected to the heaters in series was taken into consideration as a factor which influences the heating values of heaters. Beside this, the followings are considered as factors which influence the heating values of heaters, but these points were not taken into consideration.

A variation as well as voltage change in an initial state of a power supply voltage supplying an electric power to heaters leads to a variation in voltage to be applied directly to heaters. In addition, a resistance component in a connector connecting the wiring and printhead to the main body of the printer is connected (in series) between heaters resistance and a power supply so as to give rise to a voltage drop due to these resistances, and therefore change in voltage to be applied to heaters.

Moreover, the on-resistance of the above described MOS transistors is not always constant but changes as a function of temperature changes and the gate drive voltage.

Conventionally, measures have been taken against these factors, but actually no effective measures have been provided. For example, it is practiced that against the power supply voltage changes, in order to reduce the voltage a variation at the time of shipping of products, the specification on the power supply voltage is made strict or the voltage in the vicinity of he head is attempted to be stabilized with a stabilizing circuit, but such arrangement will give rise to problems of cost increase of a whole printing apparatus due to power supply's cost increase as well as increase in the number of components due to addition of additional circuits.

Wiring resistance or parasite resistance such as resistance in connectors is addressed by designing them to be sufficiently small in relation to the heaters resistance, but since the number of printing elements and heaters increase as the printing apparatus is made to provide higher quality images and rapid operations, currents flowing in wirings increase accordingly, giving rise to large voltage drop due to these parasite resistances, which has become a problem that cannot be ignored.

SUMMARY OF THE INVENTION

A first object of the present invention is to provide a printhead that can suppress influence of changes in power supply voltage and wiring resistance of a power supplying line, etc. and keep drive conditions equal on each printing element.

A second object of the present invention is to provide a printing apparatus comprising a printhead that can suppress influence of changes in power supply voltage and wiring resistance of a power supplying line, etc. and keep drive conditions equal on each printing element.

The above described first object is attained by a printhead of the present invention which is a printhead having a plurality of printing elements connected to a common power supply, wherein each printing element comprises:

- a switching element connected to the above described printing element in series for controlling driving of the above described printing element with a voltages applied to a control terminal;
- a constant voltage source using the above described power supply as a standard; and
- a voltage control circuit for controlling the terminal-to-terminal potential difference of the printing element to be equal to a voltage of the above described constant voltage source when the above described printing element is driven.

In addition, the above described second object is attained by a printing apparatus of the present invention which is a printing apparatus for storage by a printhead having a plurality of printing elements connected to a common power supply, wherein each printing element comprises:

- a switching element connected to the above described printing element in series for controlling driving of the above described printing element with a voltages applied to a control terminal;
- a constant voltage source using the above described power supply as a standard; and
- a voltage control circuit for controlling the terminal-to-terminal potential difference of the printing element to be equal to a voltage of the above described constant voltage source when the above described printing element is driven,
- and the apparatus comprises drive control means for controlling driving signals to be supplied to each printing element so that energy amount consumed by each printing element is equal.

That is, the present invention provides a printhead having a plurality of printing elements connected to a common power supply comprising a switching element connected to the above described printing element in series for controlling driving of the above described printing element with a voltages applied to a control terminal; a constant voltage source using the above described power supply as a standard; and a voltage control circuit for controlling the terminal-to-terminal potential difference of the printing element to be equal to a voltage of the above described constant voltage source when the above described printing element is driven to each printing element, wherein when storage, driving signals to be supplied to each printing element is controlled so that energy amount consumed by each printing element is equal.

Such arrangement provides high image quality by keeping a consumed energy amount in each printing element, that is, an energy amount generated at the time of driving constant regardless of external conditions and environments of the printhead.

Accordingly, changes in power supply voltage and influence of wiring resistance and parasite resistance can be reduced and costs for a power supply apparatus and wiring can be reduced. In addition, since each printing element can be driven under constant conditions regardless of changes in characteristics of internal element due to temperature changes of a printhead, storage quality can be maintained.

Moreover, it will become unnecessary to apply a voltage including additional portion as a margin equivalent to voltage drop anticipated in wiring or connection portions to a printing element for driving as conventionally conducted, and the printing element can be driven under optimum conditions, so durability of the printhead will be improved.

The voltage control circuit preferably include a dummy printing element connected to a printing element in parallel and having the same characteristic as the printing element, a dummy switching element connected to the dummy printing element in series and having the same characteristic as a switching element, and a detecting element for feeding back the detection output to a control terminal of the dummy switching element so that terminal-to-terminal potential difference of the dummy printing element is equal to the voltage of above constant voltage source.

In this case, the detection output is preferably used as a power supply for a logic circuit connected to a control terminal of the switching element to which selection signals are inputted indicating whether or not the printing element should be driven.

In addition, a constant voltage source is preferably a voltage source utilizing a band gap voltage.

Moreover, a switching element is preferably a MOS transistor.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In this specification, "print" is not only to form significant information such as characters and graphics but also to form, e.g., images, figures, and patterns on printing media in a broad sense, regardless of whether the information formed is significant or insignificant or whether the information formed is visualized so that a human can visually perceive it, or to process printing media.

At first, general structure of a typical ink-jet printer using the printhead according to the present invention will be described.

<Apparatus Main Body>

Figure 5:
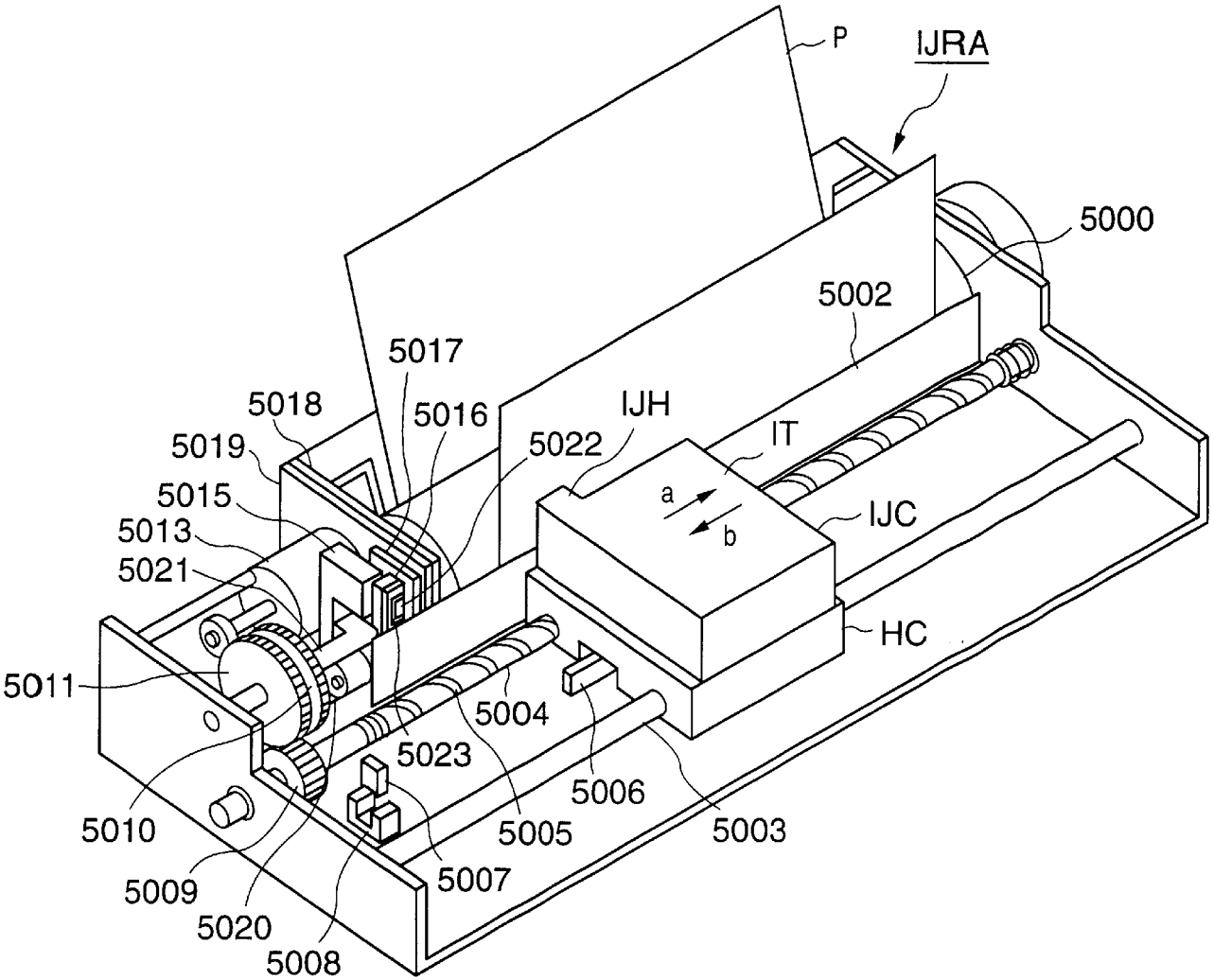
FIG. 5 is a perspective view showing an outer appearance of the construction of an ink-jet printer in a typical embodiment of the present invention.

FIG. 5 is a perspective view showing an outer appearance of the construction of an ink-jet printer IJRA as a typical embodiment of the present invention. Referring to FIG. 5, a carriage HC engages with a spiral groove 5004 of a lead screw 5005, which rotates via driving force transmission gears 5009 to 5011 upon forward/reverse rotation of a driving motor 5013. The carriage HC has a pin (not shown), and is reciprocally scanned in the directions of arrows a and b while being supported by a guide rail 5003. An integrated ink cartridge IJC, incorporating a printhead IJH and an ink tank IT, is mounted on the carriage HC.

In the describe structure, the number of ink-jet cartridge IJC mounted on the carriage HC is one, however, when a color printing is performed, a plurality of ink-jet cartridges for respective colors of CMYK are mounted on the carriage HC, or an ink-jet cartridge IJC is made to have one ink-jet printhead which discharges ink from divided areas for ink supplied from ink tanks IT containing respective ink of colors.

Reference numeral 5002 denotes a sheet pressing plate, which presses a paper sheet P against a platen 5000, ranging from one end to the other end of the scanning path of the carriage HC. Reference numerals 5007 and 5008 denote photocouplers which serve as a home position detector for recognizing the presence of a lever 5006 of the carriage in a corresponding region, and are used for switching, e.g., the rotating direction of the motor 5013.

Reference numeral 5016 denotes a member for supporting a cap member 5022, which caps the front surface of the printhead IJH; and 5015, a suction device for sucking ink residue inside the cap member. The suction device 5015 performs suction recovery of the printhead through an opening 5023 of the cap member 5015. Reference numeral 5017 denotes a cleaning blade; 5019 a member which allows the blade to be movable in the back-and-forth direction of the blade. These members are supported on a main unit support plate 5018. The shape of the blade is not limited to this, but a known cleaning blade can be used in this embodiment.

Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the home-position side region. However the present invention is not limited to this arrangement as long as desired operations are performed at known timings.

<Control Circuit>

Next, description will be provided on the control circuit for executing print control of the above-described printing apparatus.

Figure 6:
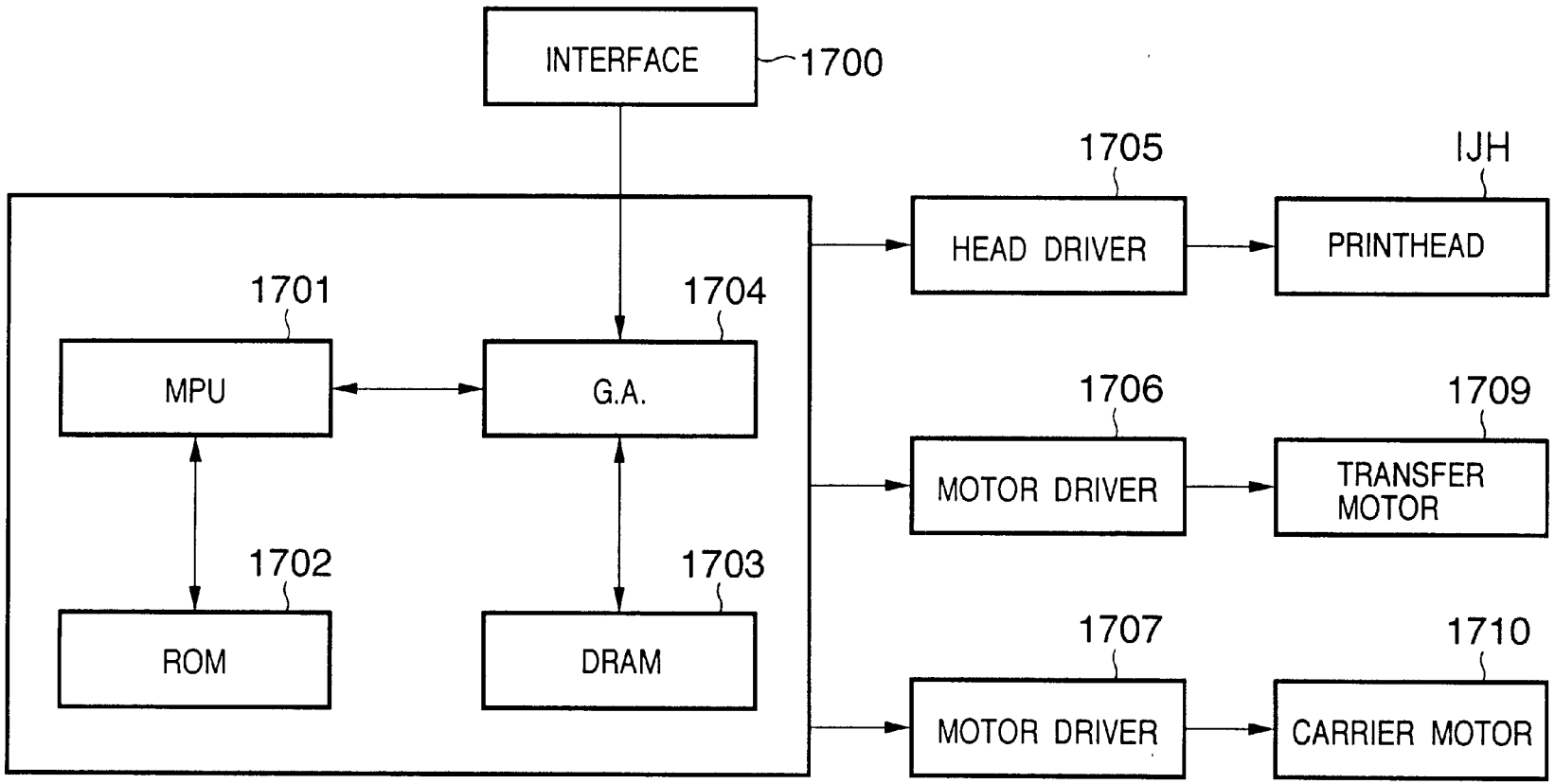
FIG. 6 is a block diagram showing a configuration of a control circuit of the ink-jet printer of FIG. 5.

FIG. 6 is a block diagram showing an arrangement of a control circuit of the ink-jet printer IJRA. Referring to FIG. 6 showing the control circuit, reference numeral 1700 denotes an interface for inputting a print signal; 1701, an MPU; 1702, a ROM for printing a control program executed by the MPU 1701; and 1703, DRAM for printing various data (aforementioned print signals, or print data supplied to the printhead IJH, and the like). Reference numeral 1704 denotes a gate array (G.A.) for controlling the supply of print data to the printhead IJH. The gate array 1704 also performs data transfer control among the interface 1700, the MPU 1701, and the DRAM 1703. Reference numeral 1710 denotes a carrier motor for conveying the printhead IJH; and 1709, a transfer motor for transferring a print medium. Reference numeral 1705 denotes a head driver for driving the printhead IJH; and 1706 and 1707, motor drivers for driving the transfer motor 1709 and the carrier motor 1710 respectively.

The operation of the aforementioned control structure is now described. When a print signal is inputted to the interface 1700, the print signal is converted to print data by the gate array 1704 and MPU 1701 intercommunicating with each other. As the motor drivers 1706 and 1707 are driven, the printhead IJH is driven in accordance with the print data transferred to the head driver 1705, thereby performing printing.

In this case, the control program executed by the MPU 1701 is stored in the ROM 1702, it is also possible to add an erasable/writable storage medium such as an EEPROM, and to change the control program stored therein from the host computer connected to the ink-jet printer IJRA.

<Ink Cartridge>

Note that the ink tank IT and printhead IJH may be integrally structured to constitute the exchangeable ink cartridge IJC as described above, or may be configured separably so as to allow exchange of only the ink tank IT when ink is exhausted.

Figure 7:
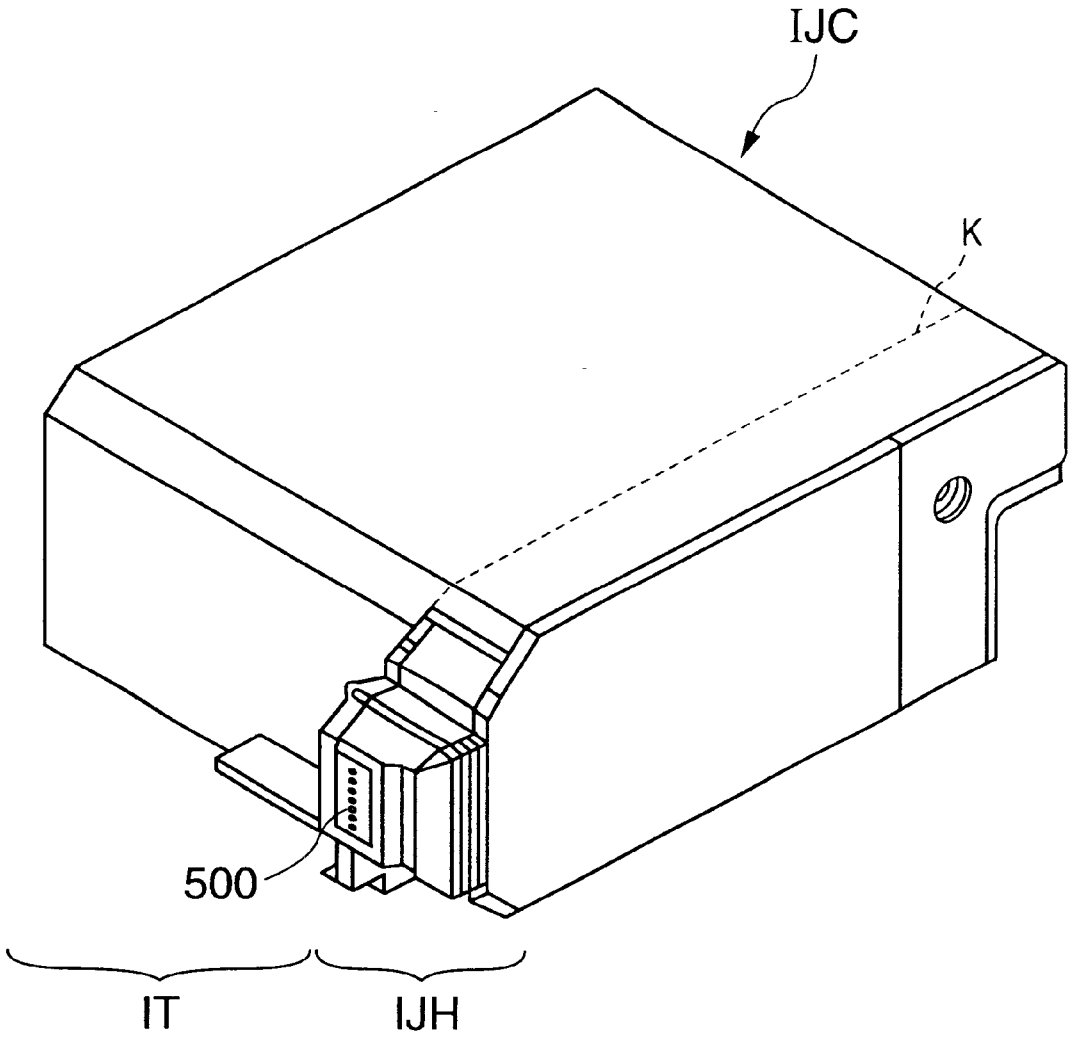
FIG. 7 is a perspective view showing an outer appearance of an ink cartridge where an ink tank and an printhead are separable.

FIG. 7 is a perspective view showing an outer appearance of the ink cartridge IJC where the printhead IJH and ink tank IT are separable. In the ink cartridge IJC shown in FIG. 7, the printhead IJH can be separated from the ink tank IT at the boundary line K. The ink cartridge IJC includes an electrical contact portion (not shown) so that the ink cartridge IJC receives electrical signals from the carriage HC when mounted on the carriage HC. The printhead IJH is driven by the received electrical signals as described before.

Note in FIG. 7, reference numeral 500 denotes an array of ink discharge orifices. The ink tank IT includes a fibrous or porous ink absorbing member for maintaining ink.

Embodiments of printheads of the present invention which are mounted onto the above described ink-jet printer will be described as follows.

[First Embodiment]

Figure 1:
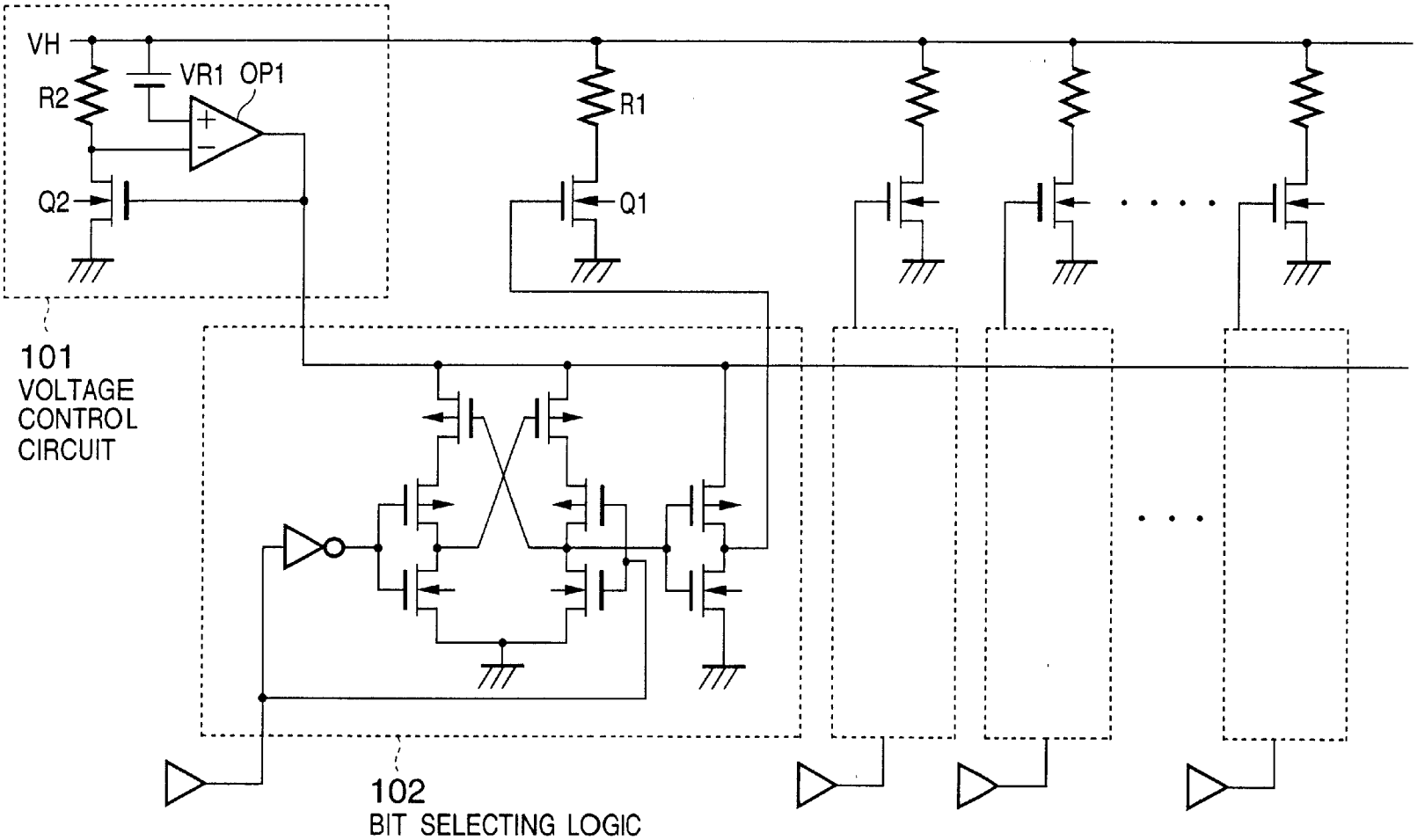
FIG. 1 is a circuit diagram showing a control circuit of each printing element of a printhead of a first embodiment of the present invention.

FIG. 1 is a circuit diagram showing configuration of a drive control circuit provided to each printing element (nozzle) in a first embodiment of a printhead of the present invention.

As illustrated, each printing element is provided with a heater R1 generating heat energy to discharge ink, a switching element Q1 such as a MOS transistor, etc. to apply currents to the heater R1, a bit selecting logic 102 for controlling voltages to be applied to the gate of the Q1 and a voltage control circuit 101 to supply the bit selecting logic 102 with a power supply.

In the voltage control circuit 101, R2 denotes a heater resistance made of the same materials as R1, and Q2 denotes a MOS transistor manufactured in the same semiconductor film manufacturing step of the same kind as Q1. That is, R2 and Q2 are manufactured in the same manufacturing steps so as to have the same characteristics as R1 and Q1 respectively being the heater and MOS for ink discharge. Vr1 denotes a constant voltage source with VH as a standard, and the operational amplifier OP1 adjusts the gate of the Q2 so as to equalize the terminal-to-terminal voltage of the heater resistance R2 and a voltage of the Vr1. Consequently, it proceeds with adjusting so as to equalize terminal-to-terminal potential difference of the heater resistance R1 and the Vr1 voltage. Here, the R2, the Q2, the Vr1 and the OP1 configure a constant voltage feedback circuit to supply the bit control logic 102 with this output as a power supply.

Operations of the circuit in FIG. 1 will be described as follows.

From the printer main body, corresponding with information to be stored, signals indicating "0" or "1" are inputted to the input IN of the bit control logic 102. In case of a circuit in FIG. 1, in the case where "0" is inputted into the input, the MOS transistor Q1 will be switched on so that a current flows in the heater R1 and ink is discharged from the nozzle.

The voltage applied to the gate of Q1 at this time is approximately equal to the power supply voltage of the bit control logic 102, and this power supply voltage is supplied by the voltage control circuit 101. As described above, since the R2 and the Q2 have the same characteristics as the R1 and the Q1 respectively, the ratio of resistivity of the R1 and ON resistivity of the Q1 is regarded same as the ratio of resistivity of the R2 and ON resistivity of the Q2. A reversal input of the operational amplifier OP1 is connected to one end of the R2 and the source of the Q2, and a constant voltage source Vr1 with the VH as a standard is connected to a non-reversal input of the operational amplifier OP1. In addition, since the gate of the Q2 is connected to the output of the OP1, OP1 is feedback to the gate voltage of the Q2 so that terminal-to-terminal potential difference of the R2 is always Vr1.

Since the output of the OP1 is a power supply for the bit control logic 102, at the time of driving the heater R1, an output voltage of the OP1, that is, the same voltage as the gate voltage of the Q2 is applied to the gate of the Q1. Since the gate voltages of the Q1 and the Q2 are made equal, the ratio of the R1 and ON resistivity of the Q1 is made equal to the ratio of the R2 and ON resistivity of the Q2 so that terminal-to-terminal potential difference of the R1 will become equal to Vr1.

Here, in the present embodiment, configuring the constant voltage source Vr1 so as not to have dependency or temperature characteristics on changes in the power supply voltage as in a band gap voltage, terminal-to-terminal potential difference of the R1 can always be held constant.

The terminal-to-terminal potential difference of the heater resistance R1 is constant with Vr1, and if the resistivity of the heater R1 is made measurable in advance with a dummy resistance, etc., a heating value P in the heater R1 is expressed as:

$$P=(Vr1^2/R1)t$$

And therefore, controlling the pulse width t corresponding with the resistivity of the heater R1 can make the heating value of the heater R1 constant.

Incidentally, components of the circuit shown in FIG. 1 can be formed onto a substrate of a printhead manufactured in semiconductor process.

As having been described so far, according to the present embodiment, terminal-to-terminal potential difference (voltage) of the heater can always be made constant without being influenced by changes of power supply voltage outside the printhead or wiring resistance and contact resistance in the wiring path up to the printhead. In addition, the voltage to be applied to each heater can be made constant without being influenced by inequality of independent ON resistance of the switching transistors connected to the heater in series or changes in ON resistance due to temperature.

[Second Embodiment]

Figure 2:
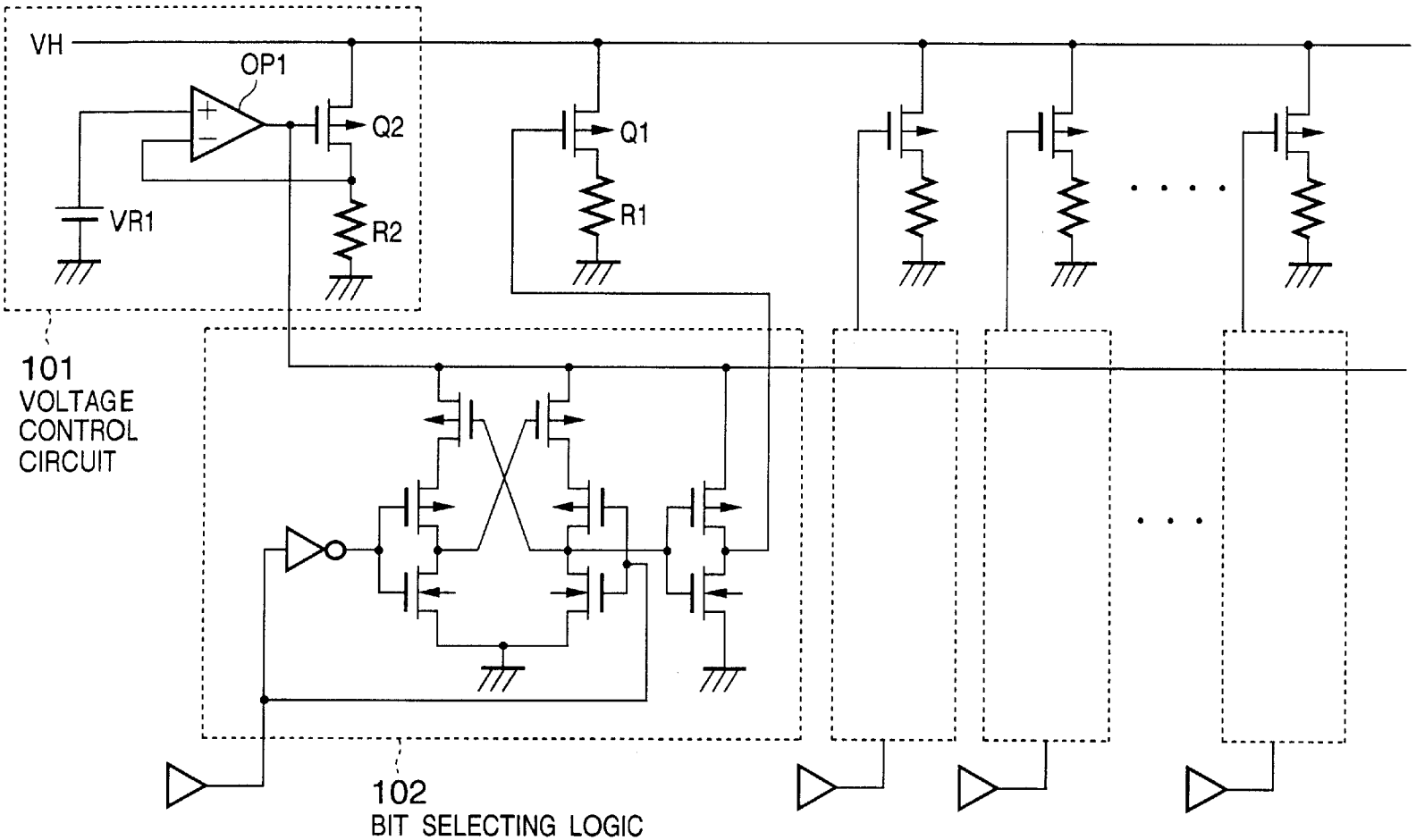
FIG. 2 is a circuit diagram showing a control circuit of each printing element of a printhead of a second embodiment of the present invention.

FIG. 2 is a circuit diagram showing configuration of a drive control circuit provided to each printing element (nozzle) in a second embodiment of a printhead of the present invention.

In the circuit diagram in FIG. 2, the components of the first embodiment corresponding with those shown in FIG. 1 are given the same reference numerals and characters, and descriptions thereon will be omitted. Difference from the first embodiment will be described as follows.

While in the first embodiment N-type MOS transistors have been used as the Q1 and the Q2, in the present embodiment P-type MOS transistors are used as the Q1 and the Q2. Therefore, the heater resistance R1 and the dummy resistance R2 are connected to the drains of the MOS transistors Q1 and Q2 respectively so as to operate to make the voltages of terminal-to-terminal potential difference of the R1 and the R2 equal to Vr1.

According to the present embodiment, advantages and effects like those in the above described first embodiment become available.

[Third Embodiment]

Figure 3:
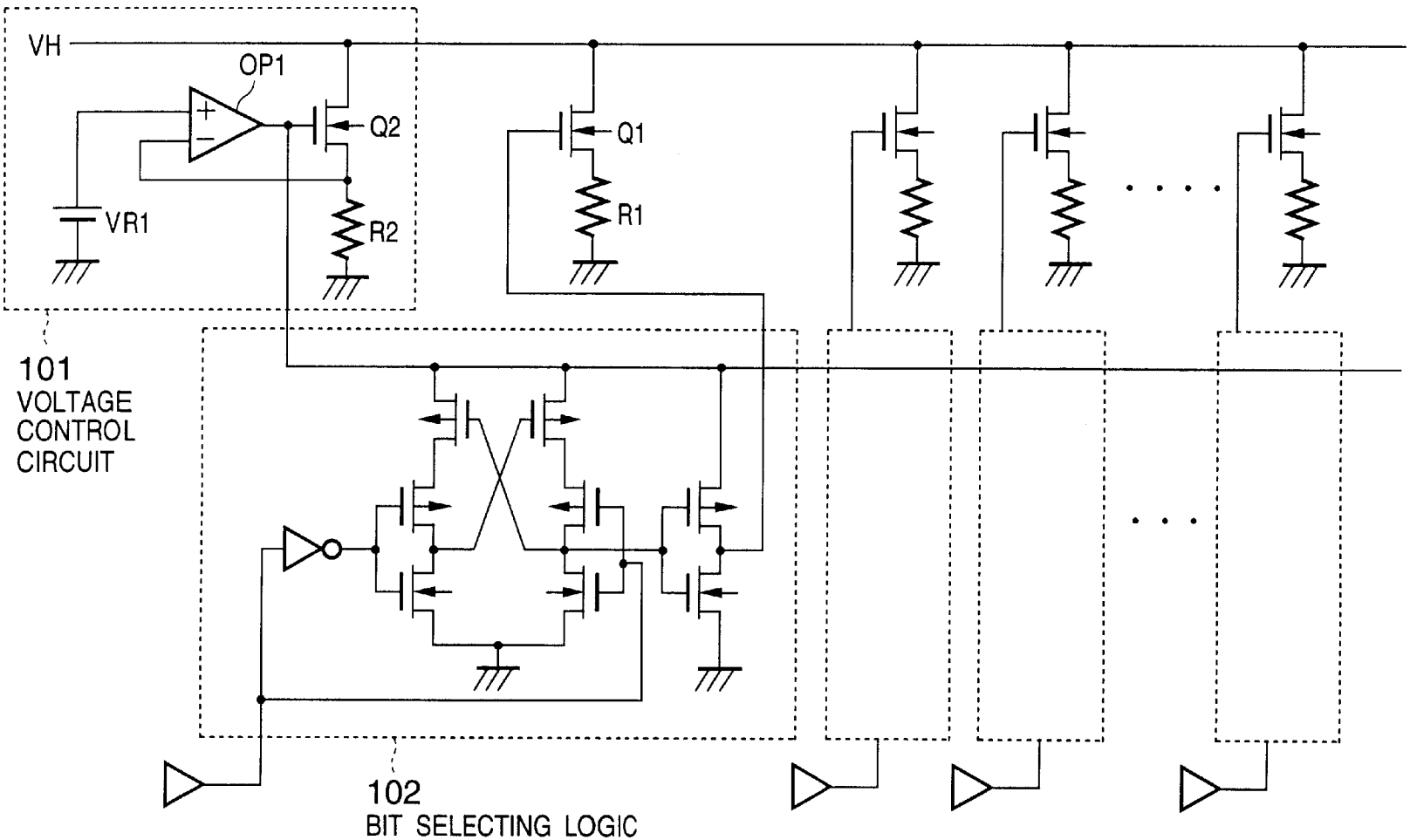
FIG. 3 is a circuit diagram showing a control circuit of each printing element of a printhead of a third embodiment of the present invention.
Figure 4:
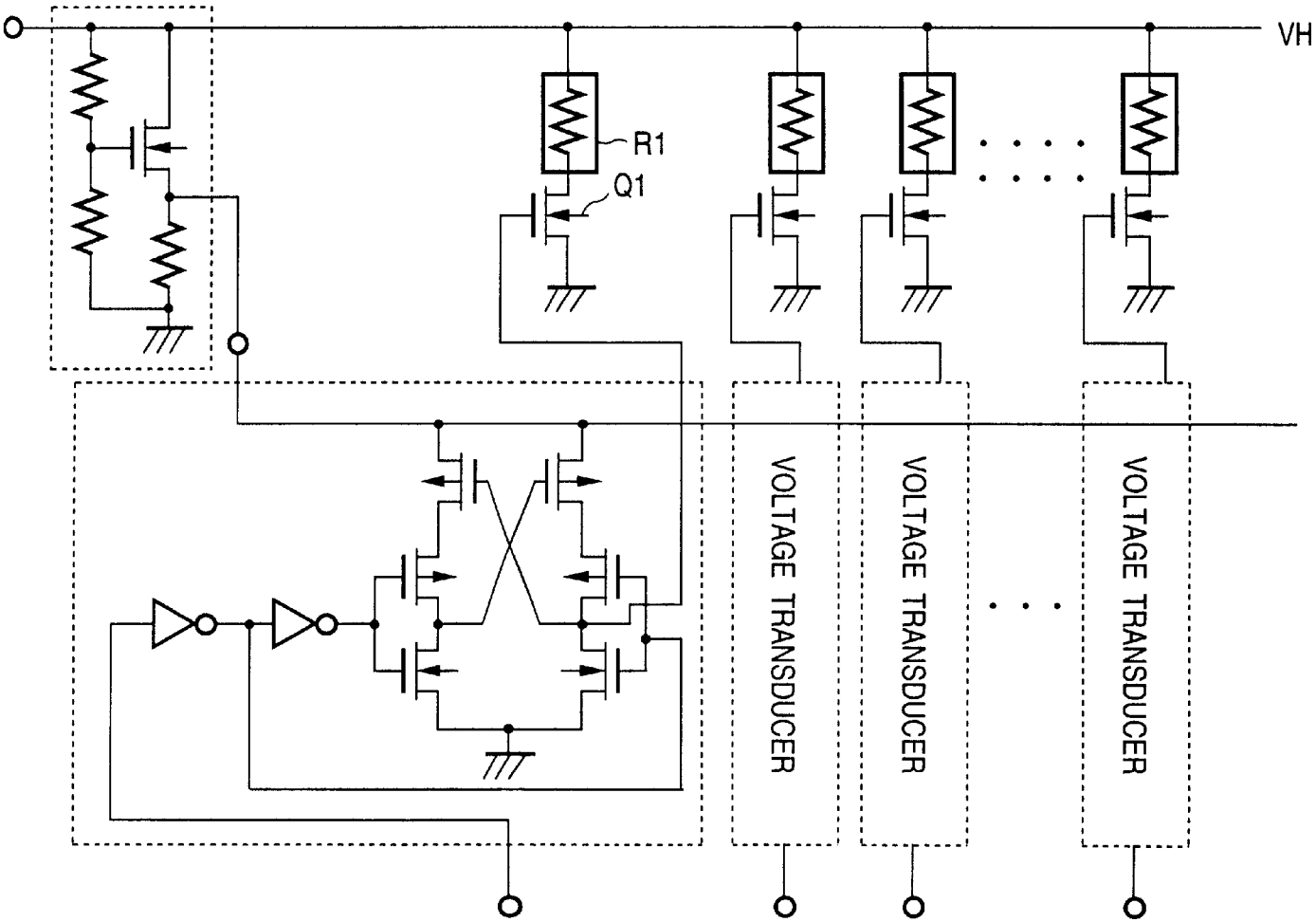
FIG. 4 is a drive circuit diagram of a prior art printhead.

FIG. 3 is a circuit diagram showing configuration of a drive control circuit provided to each printing element (nozzle) in a third embodiment of a printhead of the present invention.

In the circuit diagram in FIG. 3, the components of the second embodiment corresponding with those shown in FIG. 1 are given the same reference numerals and characters, and descriptions thereon will be omitted. Difference from the first as well as the second embodiment will be described as follows.

In the present embodiment N-type MOS transistors are used as the Q1 and the Q2. In addition, the heater resistance R1 and the dummy resistance R2 are connected to the sources of the MOS transistors Q1 and Q2 respectively so as to operate to make the voltages of the source terminals of the Q1 and the Q2 equal to Vr1.

According to the present embodiment, advantages and effects like those in the above described first and second embodiments become available.

[Other Embodiments]

In each of the embodiments described above, the circuit arrangement shown in FIGS. 1 to 4 has been explained as an arrangement for the drive control circuit of the printhead, this circuit may be built in a semiconductor substrate on which the heater is provided by utilizing a film manufacturing technology.

The embodiments having been described so far have been exemplified by a so-called ink-jet printhead in a bubble-jet system, which heats and evaporates ink rapidly with a heating body (heater) so as to discharge ink droplets form an orifice with pressure of created bubble, but in view of advantages and effects of the present invention to suppress influence of changes in a power supply voltage or a parasite resistance related to connections, it will be apparent that the present invention is applicable to a printhead to execute storage with a system other than this.

In this case, the elements used in respective methods are provided in place it the heater resistances used in the above embodiments.

In the above embodiments, droplets discharged from the printhead are ink droplets, and a liquid stored in the ink tank is ink. However the liquid to be stored in the ink tank is not limited to ink. For example, a treatment solution to be discharged onto a printing medium so as to improve the fixing property or water resistance of a printed image or its image quality may be stored in the ink tank.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can-be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead, as described in the above embodiment, which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium printing program codes for performing the aforesaid processes to a computer system or apparatus (e.g., a personal computer), reading the program codes, by a CPU or MPU of the computer system or apparatus, from the storage medium, then executing the program.

In this case, the program codes read from the storage medium realize the functions according to the embodiments, and the storage medium printing the program codes constitutes the invention.

Further, the storage medium, such as a floppy disk, a hard disk, an-optical disk, a magneto-optical disk CD-ROM, CD-R, a magnetic tape, a non-volatile type memory card, and ROM can be used for providing the program codes.

Furthermore, besides aforesaid functions according to the above embodiments are realized by executing the program codes which are read by a computer, the present invention includes a case where an OS (operating system) or the like working on the computer performs a part or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiments.

As many apparently widely different embodiments of the present invention can be made without departing from the spirit and scope thereof, it is to be understood that the invention is not limited to the specific embodiments thereof except as defined in the appended claims.

What is claimed is:

1. A printhead having a plurality of printing elements connected to a common power supply, comprising:

an N-type switching element connected to each printing element for controlling driving of said printing element;

a constant voltage source using a voltage of said power supply as a standard; and a voltage control circuit for controlling the terminal-to-terminal potential difference of said printing element to be equal to a voltage of said constant voltage source when said printing element is driven.

2. The printhead according to claim 1, wherein said constant voltage source is a voltage source utilizing a band gap voltage.

3. The printhead accordingly to claim 1, wherein said switching element is a MOS transistor.

4. The printhead according to claim 1, wherein printing operation is executed by discharging ink from each printing element.

5. The printhead according to claim 4 comprising in each printing element an electrothermal transducer for generating heat energy applied to the ink to discharge the ink by utilizing the heat energy.

6. A printhead having a plurality of printing elements, comprising:

a switching element connected to each printing element for controlling driving of said printing element;

a constant voltage source; and a voltage control circuit for controlling the terminal-to-terminal potential difference of said printing element to be equal to a voltage of said constant voltage source when said printing element is driven, wherein said voltage control circuit includes:

a dummy printing element connected to said printing element in parallel and having the same characteristic as said printing element, a dummy switching element having the same characteristic as said switching element, and a detecting element for feedbacking the detection output to a control terminal of said dummy switching element so that the terminal-to-terminal potential difference of said dummy printing element is equal to the voltage of said constant voltage source.

7. The printhead according to claim 6, wherein said detection output is used as a power supply for a logic circuit connected to said control terminal of said switching element, selection signals being inputted to said logic circuit indicating whether or not said printing element should be driven.

8. The printed according to claim 6, wherein said constant voltage source is a voltage source utilizing a band gap voltage.

9. The printhead accordingly to claim 6, wherein said switching element is an MOS transistor.

10. The printhead according to claim 6, wherein printing operation is executed by discharging ink from each printing element.

11. A printing apparatus for printing by a printhead having a plurality of printing elements connected to a common power supply, wherein said printhead comprises an N-type switching element connected to each printing element for controlling driving of said printing element, a constant voltage source using a voltage of said power supply as a standard, and a voltage control circuit for controlling the terminal-to-terminal potential difference of said printing element to be equal to a voltage of said constant voltage source when said printing element is driven, and said apparatus comprises means for providing print data for designating the printing elements to be driven with said printhead.

12. The printing apparatus according to claim 11, further comprising drive control means for controlling driving signals to be supplied to each printing element so that energy amount consumed by each printing element is equal.

13. A printhead substrate having a plurality of printing elements connected to a common power supply line, comprising:

an N-type switching element connected to each printing element for controlling driving of said printing element;

a constant voltage source using a voltage of said power supply as a standard; and a voltage control circuit for controlling the terminal-to-terminal potential difference of said printing element to be equal to a voltage of said constant voltage source when said printing element is driven.

14. A printing apparatus for printing by a printhead having a plurality of printing elements, a switching element connected to each printing element for controlling driving of said printing element, a constant voltage source, and a voltage control circuit for controlling the terminal-to-terminal potential difference of said printing element to be equal to a voltage of said constant voltage source when said printing element is driven, wherein said voltage control circuit includes a dummy printing element connected to said printing element in parallel and having the same characteristic as said printing element, a dummy switching element having the same characteristic as said switching element, and a detecting element for feedbacking the detection output to a control terminal of said dummy switching element so that the terminal-to-terminal potential difference of said dummy printing element is equal to the voltage of said constant voltage source.

15. A printhead substrate having a plurality of printing elements connected to a common power supply line, comprising:

a switching element connected to each printing element for controlling driving of said printing element;

a constant voltage source; and a voltage control circuit for controlling the terminal-to-terminal potential difference of said printing element to be equal to a voltage of said constant voltage source when said printing element is driven, wherein said voltage control circuit includes a dummy printing element connected to said printing element in parallel and having the same characteristic as said printing element, a dummy switching element having the same characteristic as said switching element, and a detecting element for feedbacking the detection output to a control terminal of said dummy switching element so that the terminal-to-terminal potential difference of said dummy printing element is equal to the voltage of said constant voltage source.

* * * * *

UNITED STATES PATENT AND TRADEMARK OFFICE

CERTIFICATE OF CORRECTION

PATENT NO. : 6,523,922 B2
DATED : February 25, 2003
INVENTOR(S) : Nobuyuki Hirayama It is certified that error appears in the above-identified patent and that said Letters Patent is hereby corrected as shown below:

Column 2,
Line 15, “suffer has” should read -- have --;
Line 16, “transistors” should read -- transistor --;
Lines 25, 31 and 47, “above described” should read -- above-described --; and
Line 56, “he” should read -- the --.

Column 3,
Lines 21 and 37, “voltages” should read -- voltage --; and
Line 56, “voltages” should read -- voltage --.

Column 4,
Line 16, “include” should read -- includes --; and
Line 60, “and an” should read -- and a --.

Column 5,
Line 23, “describe” should read -- described --.

Column 9,
Line 2, “it” should read -- of --; and
Line 63, “can-be” should read -- can be --.

Column 11,
Line 38, “accordingly” should read -- according --; and
Line 43, “claim 4” should read -- claim 4, --.

UNITED STATES PATENT AND TRADEMARK OFFICE

CERTIFICATE OF CORRECTION

PATENT NO. : 6,523,922 B2
DATED : February 25, 2003
INVENTOR(S) : Nobuyuki Hirayama It is certified that error appears in the above-identified patent and that said Letters Patent is hereby corrected as shown below:

Column 12,
Line 6, “printed” should read -- printhead --;
Line 9, “accordingly” should read -- according --; and
Line 51, “includes” should read -- includes: --.

Signed and Sealed this

Thirtieth Day of December, 2003

JAMES E. ROGAN
*Director of the United States Patent and Trademark Office*